United States Patent [19]

Aubry et al.

[11] Patent Number: 4,792,811

[45] Date of Patent: Dec. 20, 1988

[54] DEVICE FOR REFLECTING THE ELECTROMAGNETIC WAVES OF A POLARIZATION AND A METHOD OF CONSTRUCTION OF SAID DEVICE

[75] Inventors: Claude Aubry, Grygny; Jean Bouko, Villemoisson; Serge Drabowitch, Chatenay Malabray, all of France

[73] Assignee: Thomson-CSF, Paris, France

[21] Appl. No.: 852,557

[22] Filed: Apr. 16, 1986

[30] Foreign Application Priority Data

Apr. 19, 1985 [FR] France ..... 85 06006

[51] Int. Cl.[4] ..... H01Q 19/14

[52] U.S. Cl. ..... 343/781 CA; 343/756

[58] Field of Search ..... 343/781 CA, 756, 909, 343/840

[56] References Cited

U.S. PATENT DOCUMENTS

| | | | |
|---|---|---|---|
| 3,218,643 | 11/1965 | Hannan et al. | 343/781 CA |
| 3,271,771 | 6/1966 | Hannan et al. . | |
| 3,271,771 | 9/1966 | Hannan et al. | 343/781 CA |
| 3,332,083 | 7/1967 | Broussaud | 343/781 CA |
| 3,568,204 | 3/1971 | Blaisdell | 343/781 CA |
| 3,574,258 | 4/1971 | May et al. . | |
| 3,821,746 | 6/1974 | Mizusawa et al. | 343/781 CA |
| 4,017,865 | 4/1977 | Woodward | 343/781 CA |
| 4,144,535 | 3/1979 | Dragone | 343/756 |

*Primary Examiner*—William L. Sikes
*Assistant Examiner*—Hoanganh Le
*Attorney, Agent, or Firm*—Oblon, Fisher, Spivak, McClelland & Maier

[57] ABSTRACT

A microwave reflector having metallic surfaces and nonmetallic surfaces is perfectly reflecting for the waves of a first polarization and partly transparent for the waves of a second polarization orthogonal to the first. The reflector is primarily applicable to radar systems.

11 Claims, 2 Drawing Sheets

DEVICE FOR REFLECTING THE ELECTROMAGNETIC WAVES OF A POLARIZATION AND A METHOD OF CONSTRUCTION OF SAID DEVICE

BACKGROUND OF THE INVENTION

1. Field of the Invention

The primary object of the invention is to provide a device for reflecting the electromagnetic waves and a method for polarized construction of said device.

2. Description of the Prior Art

In modern radar systems, specialized channels are incorporated for collecting additional items of information and it is essential to separate the electromagnetic waves belonging to different channels. In antennas of the Cassegrain type, it is a known practice to use crossed polarizations for the various channels. For example, a principal channel operates with horizontal rectilinear polarization whilst a supplementary channel operates with vertical rectilinear polarization. Separation at the receiver takes place at the auxiliary reflector of the Cassegrain antenna which is reflecting for one polarization and transparent for the other. In the prior art, reflectors of this type were constructed by making use of parallel wires. In this design, the wires were embedded in a low-loss dielectric or constituted a grating. The auxiliary reflector of known type was neither perfectly transparent for one channel nor perfectly reflecting for the other. Theoretically, the system in fact operates only in the principal planes, namely the horizontal plane and the vertical plane.

The device in accordance with the present invention is made perfectly reflecting for one of the polarizations. Thus the incorporation of a supplementary channel in an existing radar system does not cause any disturbance in the operation of this latter. It must be pointed out, however, that the reflector in accordance with the invention is not perfectly transparent to electromagnetic waves transmitted over the supplementary channel.

SUMMARY OF THE INVENTION

The invention is primarily directed to a microwave reflector having metallic surfaces and nonmetallic surfaces, the reflector being mainly distinguished by the fact that it is perfectly reflecting for the waves of a first polarization and partly transparent for the waves of a second polarization orthogonal to the first polarization, the metallic surfaces being located at the intersections of the reflector surface with a series or pencil of lines which pass through a focal point O of said reflector and through a horizontal circle included in a sphere having a center O.

BRIEF DESCRIPTION OF THE DRAWINGS

Other features of the invention will be more apparent to those versed in the art upon consideration of the following description and accompanying drawings, wherein.

The same elements which appear in FIGS. 1 to 3 are designated by the same references.

DESCRIPTION OF THE PREFERRED EMBODIMENTS

Figure 1:
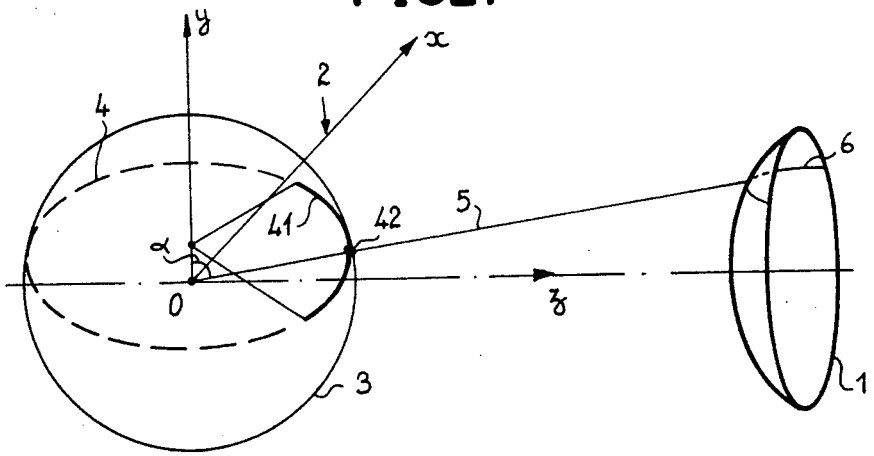
FIG. 1 is an explanatory diagram.

The principle of construction of a reflector 1 in accordance with the invention is illustrated in FIG. 1. This figure shows a reference frame of orthonormal coordinates ordinates O, $\vec{x}$, $\vec{y}$, $\vec{z}$. The axis of z is the axis of propagation of electromagnetic energy. The origin O of the reference frame corresponds for example to the aperture of a primary source. Although not shown in the drawings, said primary source can be a single-polarization rectangular horn. The aperture of the primary source produces uniform illumination with polarization, the electric field being for example parallel to the axis Ox. The field radiated in space by a source of this type is parallel to the axis Ox at all points. On a sphere 3 having a center O, the electric field lines are circles 4 included in horizontal planes. FIG. 1 shows in full lines the portion 41 of the circle 4 corresponding to real illumination. This corresponds to the directivity of the radiation sources.

In FIG. 1, a straight line 5 passes through the origin O and through a point 42 of the portion 41 of the circle 4. Let $\alpha$ denote the angle formed between the straight line 5 and the axis Oy. If the point 42 of the circle 4 is made to describe the entire portion 41, a portion of cone having an axis Oz is obtained. The intersection 6 of said cone with the non-planar reflector 1 for all circles 4 corresponds to the metallizations to be formed on the reflector 1 in order to make this latter perfectly reflecting for radiations having horizontal polarization, the electric field being parallel to Ox.

The metallizations are formed successively in a series of horizontal circles 4 forming part of the sphere 3. By way of example, the metallizations are round-section wires. In an alternative embodiment of the device in accordance with the invention, the wires are included in a dielectric material. The diameter of the wires, their spacing as well as the thickness of the dielectric are chosen in a manner known to those versed in the art. This choice is the same as for the known type of reflector consisting of parallel wires.

In another alternative embodiment of the device in accordance with the invention, metallic surfaces are formed by deposition of metallic thin films on a dielectric. This form of construction utilizes the same techniques as those employed in the fabrication of printed circuits.

For the sake of enhanced clarity of the figure, only one metallic surface is illustrated.

Figure 2:
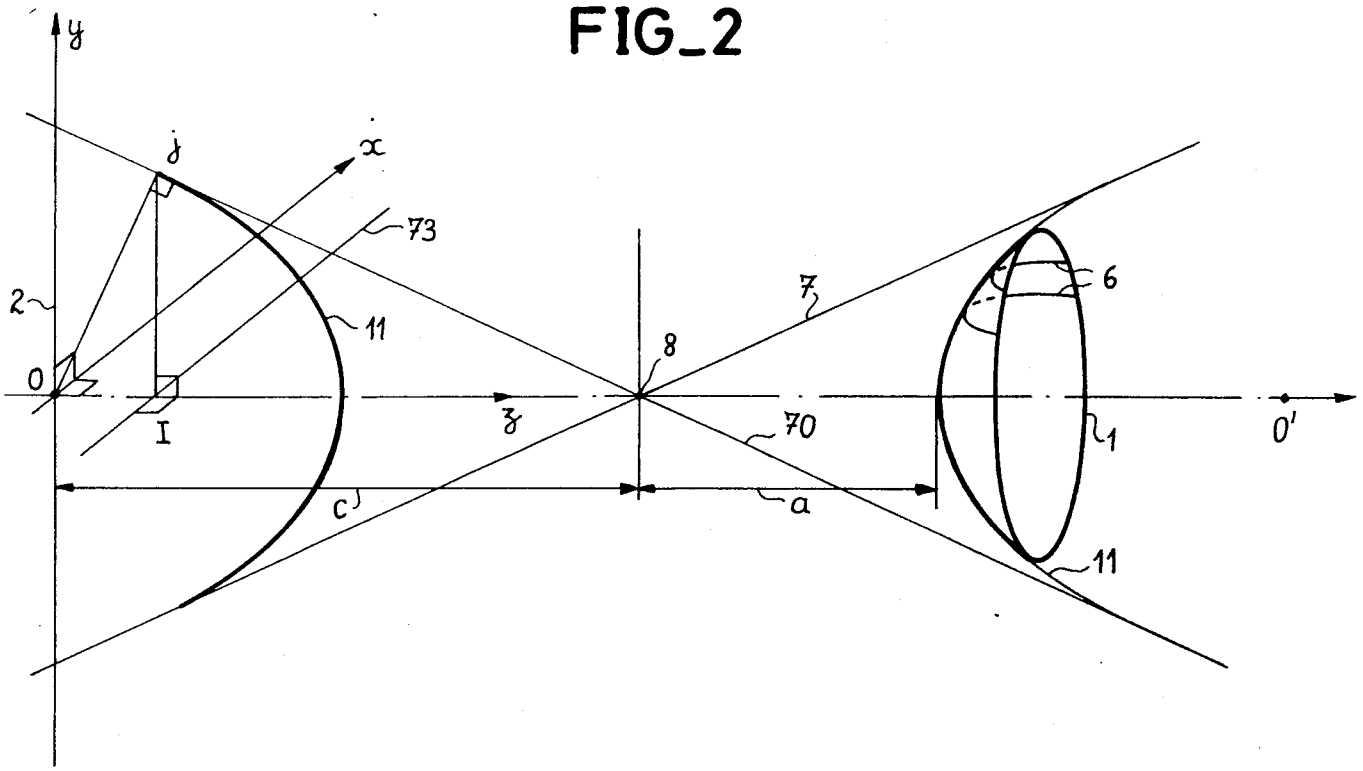
FIG. 2 is another explanatory diagram.

The explanatory diagram of FIG. 2 permits determination of the lines of current induced in the auxiliary reflector 1. In the example illustrated, the auxiliary reflector 1 is a hyperbolic reflector. The current lines obtained on the reflector 1 are sections of said reflector produced by the cones having a vertex O applied against circles included in horizontal planes. In the example illustrated in FIG. 2, these cones are cones of revolution, the vertex of which is located at the focus O of the hyperboloid of revolution 1. The lines 6 of current induced in the auxiliary reflector 1 are the plane sections of said reflector. The cone of revolution having a vertex O, an axis Oy and a semivertical angle $\alpha$ corresponds to the equation:

$$(x^2+z^2)\cos^2\alpha - y^2\sin^2\alpha = 0 \qquad (1)$$

The hyperbolic auxiliary reflector 1 corresponds to the equation:

$$b^2(z-c)^2-a^2(x^2+y^2)-a^2b^2=0 \quad (2)$$

where a designates the half-axis, the meridian line of the auxiliary reflector 1, c designates the focal half-distance of the hyperboloid 1, and $b=\sqrt{c^2-a^2}$.

By eliminating x between equation (1) and (2), we obtain:

$$ay\pm\cos\alpha(cz-b^2)=0 \quad (3)$$

Equation (3) defines a line-pencil of planes having the parameter $\alpha$ which pass through the fixed line 73 represented by the equations:

$y=0$ $z=b^2/c$

Let 11 be the hyperboloid of revolution corresponding to the auxiliary reflector. Let 7 and 70 be the asymptotes to the hyperboloids of revolution 11 included in the plane represented by the equation $x=0$. The point 8 of intersection of the lines 7 and 70 is the center of symmetry of the hyperboloid of revolution 11. Let J be the projection of the focus 0 of the hyperboloid of revolution 11 on the line 70. The letter I designates the projection of the point J on the axis Oz and the intersection of the line 73 with the plane having the equation $x=0$. The current lines 6 on the auxiliary reflector 1 are defined as the intersections of said reflector 1 with the planes represented by equation (3). By replacing the surface of the auxiliary reflector 1 by a layer of wires which closely follows the current lines 6, the device thus constructed is strictly equivalent to the auxiliary reflector 1 in the case of the radiation which has induced the current line 6.

Figure 3:
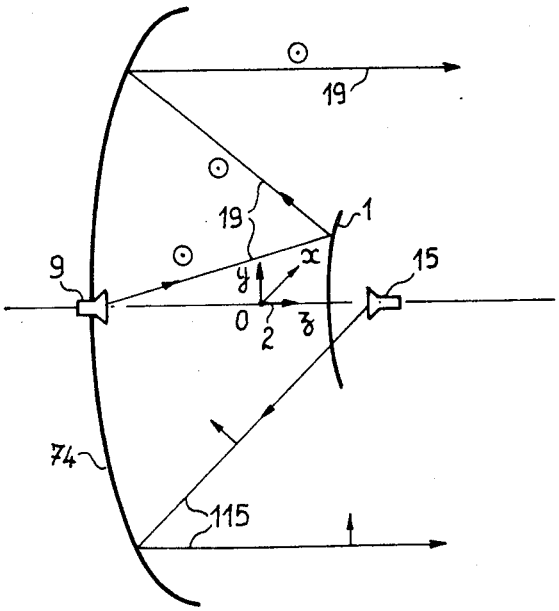
FIG. 3 is a diagram illustrating one example of construction of the device in accordance with the invention.

FIG. 3 shows one example of construction of a radar antenna in accordance with the invention. The antenna of FIG. 3 comprises a first source 9 and a second source 15 of electromagnetic radiation. The sources 9 and 15 are rectangular-aperture horns, for example. The sources 9 and 15 operate with polarizations which are orthogonal with respect to each other. The antenna further comprises an auxiliary reflector 1 and a principal reflector 74.

The source 9 corresponds to the principal channel of the antenna illustrated. In the case of the source 9, the antenna is of the Cassegrain type, the waves 19 transmitted with horizontal polarization, for example, are reflected first from the auxiliary reflector 1, then from the principal reflector 74. Replacement of an entirely metallized reflector by the auxiliary reflector 1 in accordance with the invention does not in any way disturb the operation of the channel corresponding to the source 9. The reflector 1 is perfectly reflecting for the waves produced by the source 9.

The radiation source 15 corresponds to a supplementary channel added to the antenna. In the case of this source, the antenna behaves as a monoreflector antenna. The radiation 115 produced by the source 15 with vertical polarization, for example, passes through the auxiliary reflector 1 before being reflected from the principal mirror 74. The auxiliary reflector 1 in accordance with the invention does not constitute an obstacle and does not produce any shadow effect for the radiation emitted by the source 15.

It should be mentioned that optimization of the auxiliary reflector 1 for the channel corresponding to the source 9 does not permit perfect transparency of said reflector in the case of the channel corresponding to the source 15. However, this is not very objectionable in the case of an auxiliary channel.

The invention applies primarily to multichannel radar systems.

What is claimed is:

1. A microwave reflector having metallic surfaces and nonmetallic surfaces, said metallic surfaces being positioned for perfectly reflecting the waves of a first polarization and partly transmitting the waves of a second polarization orthogonal to said first polarization, wherein the metallic surfaces are located at the intersections of the reflector surface with a series of lines which pass through a focal point 0 of said reflector and through a horizontal circle included in a sphere having a center at said focal point 0.

2. A reflector according to claim 1, wherein said reflector has a shape of a hyperboloid of revolution.

3. A reflector according to claim 1, wherein the metallic surfaces comprise wires which follow lines of current induced in said reflector.

4. A reflector according to claim 1, wherein the metallic surfaces comprise metallizations deposited on a dielectric.

5. A radar antenna, wherein said antenna comprises a reflector according to claim 1.

6. An antenna according to claim 6, wherein said antenna comprises two rectangular horns which operate with crossed polarization.

7. An antenna according to claim 5, wherein said antenna is a Cassegrain antenna for one polarization and is a monoreflector antenna for the second polarization.

8. A microwave reflector according to claim 1, wherein said reflector surface is non-planar.

9. A microwave reflector which is perfectly reflecting for the waves of a first polarization and partly transparent for the waves of a second polarization orthogonal to said first polarization, comprising metallic surfaces and nonmetallic surfaces, wherein said metallic surfaces are placed at the intersection of the reflector surface and planes represented by the equation:

$$ay\pm\cos\alpha(cz-b^2)=0$$

where y, z are the coordinates in the reference frame O, $\vec{x}$, $\vec{y}$, $\vec{z}$, a is a distance between the apex of the reflector and the intersection of the asymptotes to the reflector, c is the focal half-distance of the reflector, $b=\sqrt{c^2-a^2}$, $\alpha$is a semivertical angle.

10. A method of construction of a microwave reflector which is reflecting for a first polarization and transparent for a second polarization, wherein metallic surfaces are formed on a hyperboloid of revolution at the intersection of said hyperboloid of revolution with the planes represented by the equation:

$$ay\pm\cos\alpha(cz-b^2)=0$$

where y and z are the coordinates in the reference frame O, $\vec{x}$, $\vec{y}$, $\vec{z}$, a is the distance between the apex of the reflector and the intersection of the asymptotes to the reflector, c is the focal half-distance of the reflector, $b=\sqrt{c^2-a^2}$, $\alpha$=is a semivertical angle.

11. A method according to claim 10, wherein the metallic surfaces are wires.

* * * * *